US007161553B2

(12) United States Patent
Courtney

(10) Patent No.: US 7,161,553 B2
(45) Date of Patent: Jan. 9, 2007

(54) SATELLITE ANTENNA COVER

(76) Inventor: Michael J. Courtney, 3316 Pacific Ave., Marina Del Rey, CA (US) 90292

( * ) Notice: Subject to any disclaimer, the term of this patent is extended or adjusted under 35 U.S.C. 154(b) by 0 days.

(21) Appl. No.: 10/982,671

(22) Filed: Nov. 4, 2004

(65) Prior Publication Data

US 2006/0092089 A1 May 4, 2006

(51) Int. Cl.
*H01Q 1/42* (2006.01)

(52) U.S. Cl. ..... 343/872

(58) Field of Classification Search ..... 343/872, 343/912, 840

See application file for complete search history.

(56) References Cited

U.S. PATENT DOCUMENTS

| | | | | |
|---|---|---|---|---|
| 4,804,972 | A * | 2/1989 | Schudel | 343/840 |
| 5,451,972 | A | 9/1995 | Franklin | 343/840 |
| 5,528,253 | A | 6/1996 | Franklin | 343/840 |
| 5,729,241 | A | 3/1998 | Ergen et al. | 343/872 |
| 5,798,735 | A | 8/1998 | Walton, Jr. | 343/704 |
| 5,815,125 | A | 9/1998 | Kelly et al. | 343/872 |
| 5,907,310 | A * | 5/1999 | Seewig et al. | 343/786 |
| 5,940,047 | A | 8/1999 | Pfnister | 343/872 |
| 6,064,344 | A * | 5/2000 | Walton | 343/704 |
| 6,714,167 | B1 | 3/2004 | Gusick, Jr. | 343/872 |
| 2005/0035923 | A1 * | 2/2005 | Syed et al. | 343/872 |

* cited by examiner

*Primary Examiner*—Hoanganh Le
(74) *Attorney, Agent, or Firm*—Cislo & Thomas, LLP

(57) ABSTRACT

A satellite antenna cover of substantially rigid configuration is adapted at one end to securely snap around the entire signal-receiving perimeter of a satellite antenna. The securely snapped satellite antenna cover permits transmission of satellite signals and includes a substantially rigid outer surface suitable for decorative and advertising use. The satellite antenna cover is constructed of generally rigid weather-proof plastic adapted to protect the signal-receiving face of the satellite antenna from damaging UV (Ultra Violet) radiation, inclement weather and debris.

6 Claims, 4 Drawing Sheets

FIG. 5
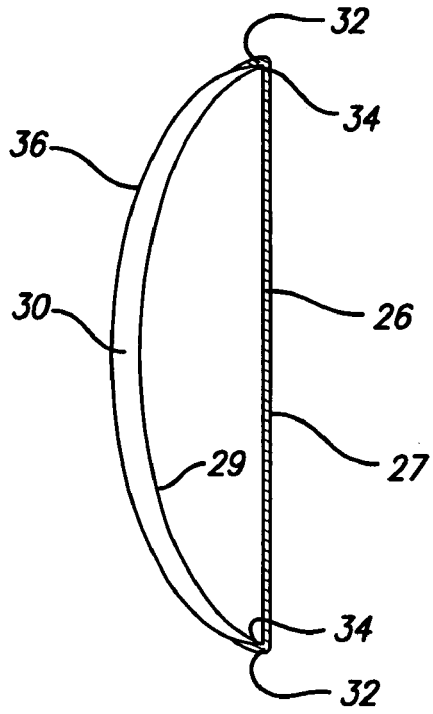
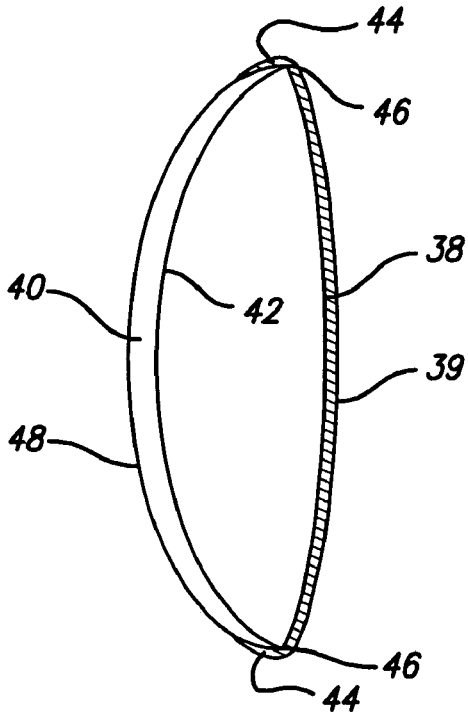
FIG. 6

SATELLITE ANTENNA COVER

BACKGROUND

When rain or snow collects in the bottom portion of an uncovered satellite dish of a standard parabolic configuration, the moisture content scatters the broadcast signal and prevents it from focusing properly on the feed horn. When enough of a TV broadcast signal is scattered, the picture is lost on the TV set. After a heavy snowfall, the sheer weight of the snow pulls the aim of the dish down below the satellite arc resulting in compromised picture quality for the user. Repeated heavy snowfall or hail may lead to perforation of the satellite dish, reducing the accuracy of the signal-receiving (reflective) surface. In some satellite dish antennas, the added weight of snow puts unnecessary stress on the actuator and motor which causes premature failure of either or both.

On clear days, a certain amount of the sun's heat and UV (Ultra Violet) rays are focused back at the feed horn, raising the temperature of the LNB (Low Noise Block) down converter unit, causing undesired noise or interference in the transmitted picture and accelerating the breakdown of the components. In light colored fiberglass antennas or solid metal antennas from which the paint has peeled off, prolonged heat and UV exposure may cause melting of the feed horn.

To combat these weather-related problems, the satellite antenna industry is encouraging antenna owners to use satellite dish covers. Some satellite dish covers are made from slick cloth-like material with the installed cover defining a somewhat vertical surface to help rain, snow, hail and/or various debris, such as leaves, pine needles, bird droppings and the like, slide off the cover. The cover material passes satellite signals through with virtually no signal attenuation and allows focusing of the same via the feed horn. The cloth-like cover is normally stretched on the front signal-receiving face while being attached to the back of the satellite dish via a drawstring arrangement or the like.

A tightly stretched satellite dish cover made of weatherproof cloth-like material reflects the sun's energy away from the satellite dish while maintaining the antenna at a fraction of the cost of purchasing a new satellite antenna. Unfortunately, this type of cloth-like arrangement deteriorates over time and leads to sagging of the dish cover in certain areas, which affects signal reception quality.

Some satellite covers incorporate corporate logos, OEM (Original Equipment Manufacturer) labels or private labeling from mass distributors. Some flat planar-array antennas eliminate covers entirely by printing text and/or graphics directly on the signal-receiving face of the antenna. Other satellite antennas use the signal-receiving face for application of decals, labels, 35 mm film strips and/or the like. None of the satellite antennas use covers of substantially rigid configuration that can securely snap around the entire signal-receiving perimeter of the antenna and permit transmission of satellite signals. Such satellite antenna covers would be well suited for decorative and advertising use as well as for mass-manufacturing at a reasonable cost to the user.

SUMMARY

Exemplary embodiments disclosed herein are generally directed to a satellite antenna cover.

In accordance with one aspect of the invention, a satellite antenna cover of substantially rigid configuration is adapted at one end to securely snap around the entire signal-receiving perimeter of a satellite antenna. The securely snapped satellite antenna cover permits transmission of satellite signals and includes an outer surface adapted for decorative and advertising use.

In accordance with another aspect of the invention, a satellite antenna cover constructed of substantially rigid plastic material is adapted at one end to securely snap around the entire signal-receiving perimeter of a satellite antenna. The securely snapped satellite antenna cover permits transmission of satellite signals and includes an outer surface adapted for decorative and advertising use.

In accordance with yet another aspect of the invention, a cover for a satellite antenna having a signal-receiving face, an outer rim and a back surface comprises a substantially rigid surface adapted to shroud the entire signal-receiving face of the satellite antenna and permit transmission of satellite signals. The substantially rigid surface is suitable for decorative and advertising use. The satellite antenna cover also comprises at least one curved outer flap integrally formed on the substantially rigid surface and being adapted to securely snap onto at least one portion of the outer rim and back surface of the satellite antenna.

In accordance with still another aspect of the invention, a cover for a satellite antenna having a concave signal-receiving face, an outer rim and a back surface comprises a substantially rigid surface adapted to conform substantially to the contours of the concave signal-receiving face of the satellite antenna and permit transmission of satellite signals. The substantially rigid conforming surface is suitable for decorative and advertising use. The satellite antenna cover also comprises at least one curved outer flap integrally formed on the substantially rigid conforming surface and being adapted to securely snap onto at least one portion of the outer rim and back surface of the satellite antenna.

In accordance with another aspect of the invention, a cover for a satellite antenna having a concave signal-receiving face, an outer rim and a back surface comprises a substantially flat rigid surface adapted to shroud the entire signal-receiving face of the concave signal-receiving face of the satellite antenna and permit transmission of satellite signals. The substantially flat rigid surface is suitable for decorative and advertising use. The satellite antenna cover also comprises at least one curved outer flap integrally formed on the substantially flat rigid surface and being adapted to securely snap onto at least one portion of the outer rim and back surface of the satellite antenna.

In accordance with yet another aspect of the invention, a cover for a satellite antenna having a concave signal-receiving face, an outer rim and a back surface comprises a substantially convex rigid surface adapted to shroud the entire signal-receiving face of the concave signal-receiving face of the satellite antenna and permit transmission of satellite signals. The substantially convex rigid surface is suitable for decorative and advertising use. The satellite antenna cover also comprises at least one curved outer flap integrally formed on the substantially convex rigid surface and being adapted to securely snap onto at least one portion of the outer rim and back surface of the satellite antenna.

In accordance with still another aspect of the invention, a cover for a satellite antenna having a signal-receiving face, an outer rim and a back surface comprises a substantially rigid surface adapted to conform substantially to the contours of the signal-receiving face of the satellite antenna and permit transmission of satellite signals. The substantially rigid conforming surface is suitable for decorative and advertising use. The satellite antenna cover also comprises at least one curved outer flap integrally formed on the substantially rigid conforming surface and being adapted to securely snap onto at least one portion of the outer rim and back surface of the satellite antenna.

In accordance with a different aspect of the invention, a cover for a satellite antenna having a signal-receiving face, an outer rim and a back surface comprises a substantially rigid surface adapted to conform substantially to the contours of the signal-receiving face of the satellite antenna and permit transmission of satellite signals. The substantially rigid conforming surface is suitable for decorative and advertising use. The satellite antenna cover also comprises at least one curved outer lip integrally formed on the substantially rigid conforming surface and adapted to frictionally wrap around the outer rim of the satellite antenna. The frictionally wrapped outer lip provides secure snap fit attachment around the entire signal-receiving perimeter of the satellite antenna.

In accordance with a still different aspect of the invention, a cover for a satellite antenna having a signal-receiving face, an outer rim and a back surface comprises a substantially rigid surface adapted to conform substantially to the contours of the signal-receiving face of the satellite antenna and permit transmission of satellite signals. The substantially rigid conforming surface is suitable for decorative and advertising use. The satellite antenna cover also comprises at least one terminal tab integrally formed on the substantially rigid conforming surface and adapted to provide secure snap fit attachment around the entire signal-receiving perimeter of the satellite antenna.

These and other aspects of the invention will become apparent from a review of the accompanying drawings and the following detailed description of the invention.

BRIEF DESCRIPTION OF THE DRAWINGS

The invention is generally shown by way of reference to the accompanying drawings in which:

FIG. 5 is a cross-sectional view of a satellite antenna dish equipped with a dish cover in accordance with yet another exemplary embodiment of the present invention;

FIG. 6 is a cross-sectional view of a satellite antenna dish equipped with a dish cover in accordance with still another exemplary embodiment of the present invention.

DETAILED DESCRIPTION

The detailed description set forth below in connection with the appended drawings is intended as a description of exemplary embodiments and is not intended to represent the only forms in which the exemplary embodiments may be constructed and/or utilized. The description sets forth the functions and the sequence of steps for constructing and operating the exemplary embodiments in connection with the illustrated embodiments. However, it is to be understood that the same or equivalent functions and sequences may be accomplished by different embodiments that are also intended to be encompassed within the spirit and scope of the invention.

Some embodiments of the invention will be described in detail with reference to the related drawings of FIGS. 1–7. Additional embodiments, features and/or advantages of the invention will become apparent from the ensuing description or may be learned by practicing the invention. In the figures, the drawings are not to scale with like numerals referring to like features throughout both the drawings and the description.

Figure 1:
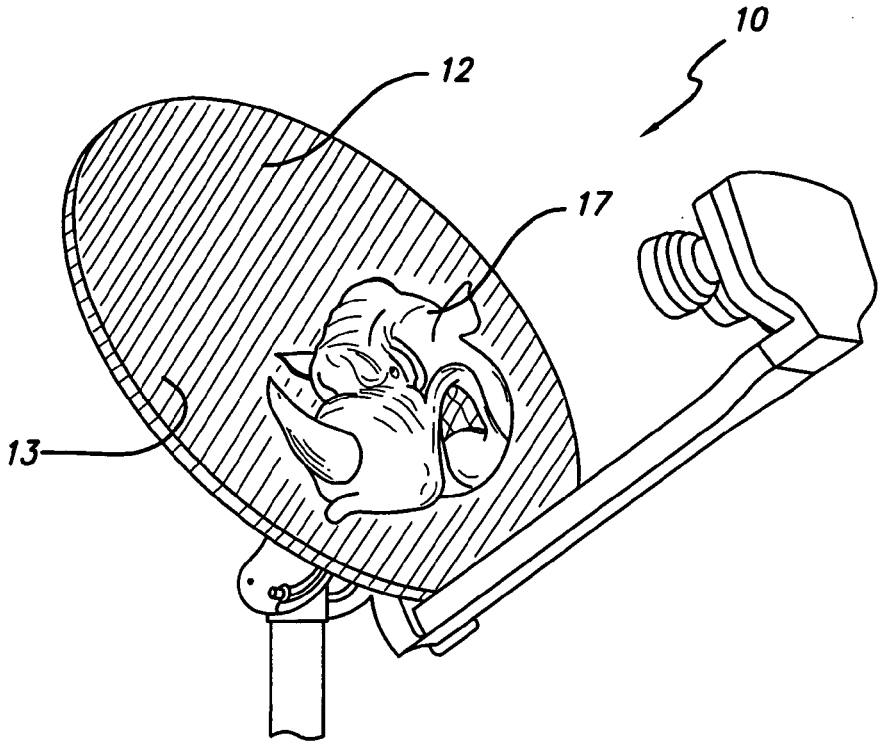
FIG. 1 is a perspective view of a satellite dish antenna equipped with a dish cover in accordance with an exemplary embodiment of the present invention.
Figure 2:
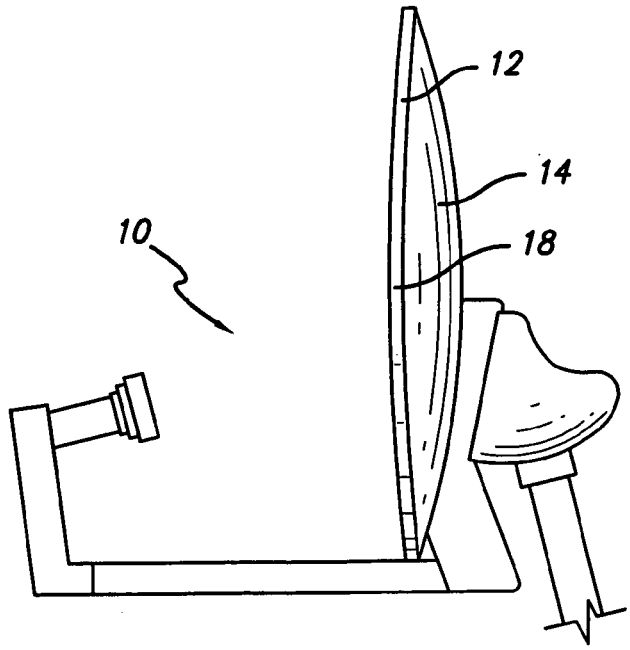
FIG. 2 is a side elevational view of the satellite dish antenna of FIG. 1.

FIG. 1 is a perspective view of a satellite dish antenna 10 equipped with a dish cover 12 in accordance with an exemplary embodiment of the present invention. Dish cover 12 shrouds the entire front signal-receiving face of antenna dish 14 (FIG. 2) with the outer surface of the signal-receiving face being of a generally concave configuration, as generally shown in FIG. 1. Dish cover 12 may be made from generally rigid weather-proof material which does not inhibit transmission of satellite communication signals and avoids the sagging problems encountered in prior art arrangements.

For example, dish cover 12 may be manufactured from durable and generally rigid plastic adapted to permit transmission of satellite communication signals to/from antenna dish 14 and effectively protect the signal-receiving face of satellite dish 14 from damaging UV radiation by the sun, inclement weather and/or various debris such as vegetation, bird droppings and the like, i.e. it is generally waterproof, cold crack resistant, high heat resistant, tear resistant and the like. In accordance with the general principles of the present invention, the term "plastic" is generally defined herein as any of various organic compounds produced by polymerization, and capable of being molded, extruded, and/or cast into various shapes.

Dish cover 12 conforms substantially to the outer contours of the generally concave signal-receiving face of antenna dish 14. Dish cover 12 is provided with a generally curved outer lip 18 (FIG. 2) which frictionally wraps around the outer rim of antenna dish 14. Dish cover 12 is adapted to snap on antenna dish 14 with outer lip 18 providing secure snap fit attachment for dish cover 12 around the entire signal-receiving perimeter of antenna dish 14.

The "snap-on" dish cover 12 may be configured for removal by the user without the use of tools. Alternatively, the snap fit attachment provided by outer lip 18 may be sufficiently tensioned to prevent removal by the user without the use of tools. The need for complicated dish cover attachment setups involving cables, ties and the like, as practiced in prior art devices, is avoided.

Once installed over antenna dish 14, dish cover 12 provides a generally rigid concave outer surface 13 (FIG. 1) suitable for decorative and/or advertising use. For example, outer surface 13 may include a sports team logo 17, as generally illustrated in FIG. 1. Other usage of outer surface 13 may include applying text and/or graphics in the form of decals, labels, stickers and the like using a variety of processes such as screen printing, silk-screen printing and the like. Applied text and/or graphics may depict political or humorous messages, slogans, product advertising and/or the like. Outer lip 18 (FIG. 2) is integrally formed on rigid outer surface 13 (FIG. 1).

Figure 3:
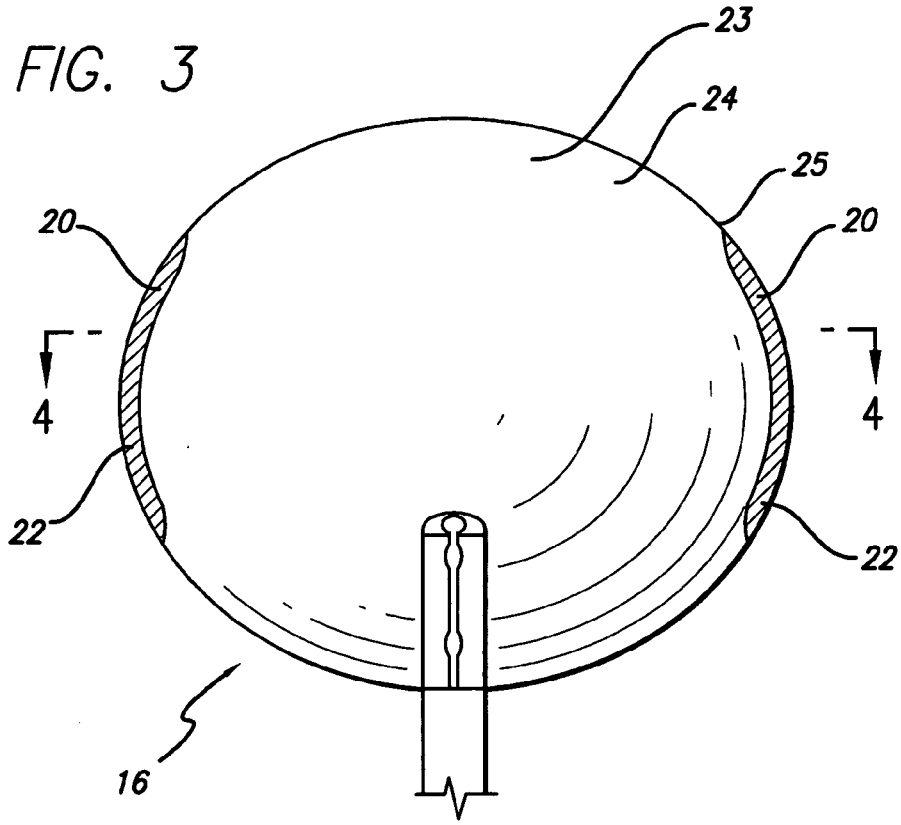
FIG. 3 is a back elevational view of a satellite dish antenna equipped with a dish cover in accordance with another exemplary embodiment of the present invention.
Figure 4:
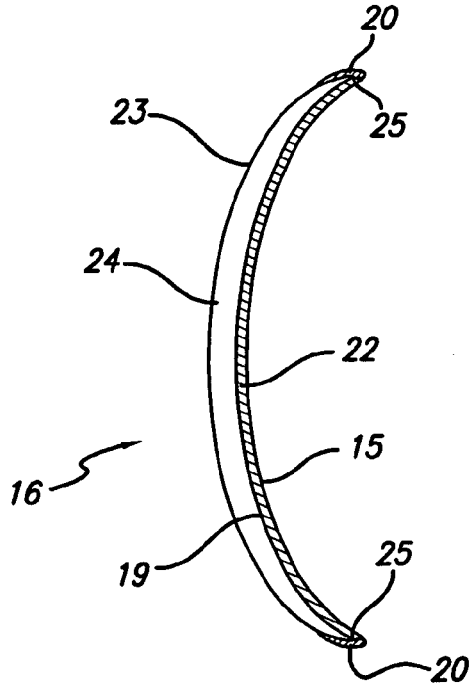
FIG. 4 is a cross-sectional view taken along section line 4—4 of FIG. 3.

FIG. 3 is a back elevational view of a satellite dish antenna 16 equipped with a dish cover 22 in accordance with another exemplary embodiment of the present invention. As generally depicted in FIG. 4, dish cover 22 conforms substantially to the outer contours of a generally concave signal-receiving face 19 of antenna dish 24. Dish cover 22 includes generally curved outer flaps 20 (FIGS. 3–4) adapted to securely grip portions of outer rim 25 and back surface 23 of antenna dish 24, as generally shown in FIG. 4. Dish cover 22 is adapted to snap on antenna dish 24 with outer flaps 20 providing secure snap fit attachment for dish cover 22 around the entire signal-receiving perimeter of antenna dish 24.

Dish cover 22 shrouds the entire signal-receiving face 19 of antenna dish 24 while permitting transmission of satellite communication signals to/from antenna dish 24. Dish cover 22 may be constructed from generally rigid weather-proof plastic which avoids the sagging problems encountered in prior art devices. The plastic material effectively protects signal-receiving face 19 from damaging UV radiation by the sun, inclement weather and/or various debris such as vegetation, bird droppings and the like, i.e. it is generally waterproof, cold crack resistant, high heat resistant, tear resistant and the like.

Once installed over antenna dish 24, dish cover 22 provides a generally rigid concave outer surface 15 (FIG. 4) suitable for decorative and/or advertising use. Outer flaps 20 are integrally formed on rigid outer surface 15.

FIG. 5 is a cross-sectional view of a satellite antenna dish 30 equipped with a dish cover 26 in accordance with yet another exemplary embodiment of the present invention. Dish cover 26 is of a substantially flat configuration relative to the outer contours of a generally concave signal-receiving face 29 of antenna dish 30. Dish cover 26 includes generally curved outer flaps 32 adapted to securely grip portions of outer rim 34 and back surface 36 of antenna dish 30, as generally shown in FIG. 5. Dish cover 26 is adapted to snap on antenna dish 30 with outer flaps 32 providing secure snap fit attachment for dish cover 26 around the entire signal-receiving perimeter of antenna dish 30.

Dish cover 26 shrouds the entire signal-receiving face 29 of antenna dish 30 while permitting transmission of satellite communication signals to/from antenna dish 30. Dish cover 26 may be constructed from generally rigid weather-proof plastic which avoids the sagging problems encountered in prior art devices. The plastic material effectively protects signal-receiving face 29 from damaging UV radiation by the sun, inclement weather and/or various debris such as vegetation, bird droppings and the like, i.e. it is generally waterproof, cold crack resistant, high heat resistant, tear resistant and the like.

Once installed over antenna dish 30, dish cover 26 provides a generally rigid flat outer surface 27 (FIG. 5) suitable for decorative and/or advertising use. Outer flaps 32 are integrally formed on rigid outer surface 27.

FIG. 6 is a cross-sectional view of a satellite antenna dish 40 equipped with a dish cover 38 in accordance with still another exemplary embodiment of the present invention. Dish cover 38 is of a substantially convex configuration relative to the outer contours of a generally concave signal-receiving face 42 of antenna dish 40. Dish cover 38 includes generally curved outer flaps 44 adapted to securely grip portions of outer rim 46 and back surface 48 of antenna dish 40, as generally shown in FIG. 6. Dish cover 38 is adapted to snap on antenna dish 40 with outer flaps 44 providing secure snap fit attachment for dish cover 38 around the entire signal-receiving perimeter of antenna dish 40.

Dish cover 38 shrouds the entire signal-receiving face 42 of antenna dish 40 while permitting transmission of satellite communication signals to/from antenna dish 40. Dish cover 38 may be constructed from generally rigid weather-proof plastic which avoids the sagging problems encountered in prior art devices. The plastic material effectively protects signal-receiving face 42 from damaging UV radiation by the sun, inclement weather and/or various debris such as vegetation, bird droppings and the like, i.e. it is generally waterproof, cold crack resistant, high heat resistant, tear resistant and the like.

Once installed over antenna dish 40, dish cover 38 provides a generally rigid convex outer surface 39 (FIG. 6) suitable for decorative and/or advertising use. Outer flaps 44 are integrally formed on rigid outer surface 39.

Figure 7:
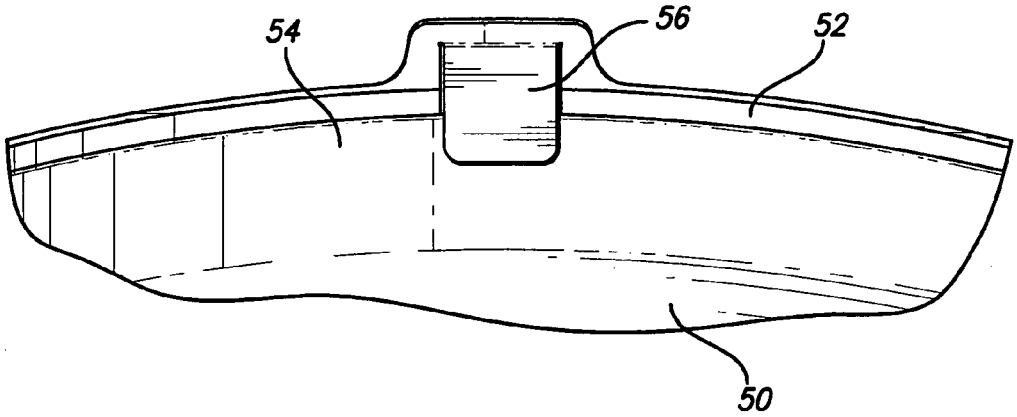
FIG. 7 is a partial perspective view of a satellite antenna dish equipped with a dish cover in accordance with an alternative exemplary embodiment of the present invention.

FIG. 7 is a partial perspective view of a satellite antenna dish 50 equipped with a dish cover 52 in accordance with an alternative exemplary embodiment of the present invention. Dish cover 52 is adapted to shroud the entire front signal-receiving face of antenna dish 50 which is generally concave. Dish cover 52 permits transmission of satellite communication signals to/from antenna dish 50. The concave signal-receiving face of antenna dish 50 terminates with an extended and generally curved outer rim 54.

Dish cover 52 may be made from generally rigid weather-proof material, such as plastic, which does not inhibit transmission of satellite communication signals and protects the signal-receiving face of satellite dish 50 from damaging UV radiation by the sun, inclement weather and/or various debris such as vegetation, bird droppings and the like. This type of dish cover material is generally waterproof, cold crack resistant, high heat resistant, tear resistant and the like.

Dish cover 52 conforms substantially to the outer contours of the generally concave signal-receiving face and extended outer rim 54 of antenna dish 50. Dish cover 52 is provided with a plurality of generally elongated spring-like terminal tabs, such as tab 56, adapted to partially snap over outer rim 54 of antenna dish 50, as generally depicted in FIG. 7. Dish cover 52 is configured to snap on antenna dish 50 with the terminal tabs, such as tab 56, providing a secure snap fit attachment for dish cover 52 around the entire signal-receiving perimeter of antenna dish 50. The "snap-on" dish cover 52 may be easily removed by the user without the use of any tools. Once installed over antenna dish 50, dish cover 52 provides a generally rigid concave outer surface suitable for decorative and/or advertising use.

A person skilled in the art would readily recognize that various other satellite cover attachment arrangements may be utilized, provided such other attachment arrangements do not depart from the intended purpose of the present invention.

The satellite antenna cover of the present invention is not limited for use on satellite antennas of the concave signal-receiving (reflective) face type. For example, each one of the exemplary dish cover embodiments, generally shown and described hereinabove in reference to FIGS. 5 and 6, may be readily modified for use on satellite antennas of the flat planar-array type. For example, one such flat planar-array antenna that would be well suited for use with the satellite antenna cover of the present invention incorporates a plurality of receivers on its face adapted to collect signals sent by one or more satellites. The collected signals are passed via printed circuits to an amplifier (LNB) which is integrated at the back of the antenna.

Other components and/or configurations may be utilized, provided such other components and/or configurations remain within the intended scope of the present invention . . . Other materials may be used to construct the satellite dish cover of the present invention, provided such other materials do not deviate from the intended scope and spirit of the present invention. The generally rigid outer surface of the signal-receiving face of the satellite dish cover of the present invention offers users convenient medium for decorative and/or advertising use.

A person skilled in the art would appreciate that exemplary embodiments described hereinabove are merely illustrative of the general principles of the present invention. Other modifications or variations may be employed that are within the scope of the invention. Thus, by way of example, but not of limitation, alternative configurations may be utilized in accordance with the teachings herein. Accordingly, the drawings and description are illustrative and not meant to be a limitation thereof.

Moreover, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Thus, it is intended that the invention cover all embodiments and variations thereof as long as such embodiments and variations come within the scope of the appended claims and their equivalents.

What is claimed is:

1. A satellite antenna cover comprising:

a flat rigid surface configured to shroud the entire signal-receiving face of a satellite antenna dish while permitting transmission of satellite communication signals to and from the satellite antenna dish; and at least one outer flap integrally formed on said flat rigid surface and adapted to securely grip at least one portion of the satellite antenna dish during installation, said flat rigid surface being adapted for decorative and advertising use while preventing the retainment of water, snow and debris thereon during inclement weather conditions.

2. The satellite antenna cover of claim 1, wherein said flat surface is constructed from substantially rigid weather-proof material to prevent sagging during use.

3. The satellite antenna cover of claim 1, wherein said at least one outer flap is constructed from weather-proof plastic material.

4. The satellite antenna cover of claim 2, wherein said substantially rigid weather-proof material is plastic.

5. The satellite antenna cover of claim 1, wherein said at least one outer flap is of a substantially curved configuration.

6. The satellite antenna cover of claim 4, wherein said substantially rigid weather-proof plastic material is adapted to protect the signal-receiving face of the satellite antenna dish from damaging UV (Ultra Violet) radiation, inclement weather and debris.

* * * * *